US006941906B2

(12) United States Patent
Carlsson et al.

(10) Patent No.: US 6,941,906 B2
(45) Date of Patent: Sep. 13, 2005

(54) CRANKCASE SCAVENGED INTERNAL COMBUSTION ENGINE

(75) Inventors: Bo Carlsson, Alingsas (SE); Mikael Bergman, Tormenosgatan (SE)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 10/477,285

(22) PCT Filed: May 11, 2001

(86) PCT No.: PCT/SE01/01028

§ 371 (c)(1),
(2), (4) Date: Nov. 10, 2003

(87) PCT Pub. No.: WO02/092978

PCT Pub. Date: Nov. 21, 2002

(65) Prior Publication Data

US 2004/0168656 A1 Sep. 2, 2004

(51) Int. Cl.[7] ..... F02B 33/04

(52) U.S. Cl. ..... 123/73 PP; 123/55.6; 123/65 VB; 123/430

(58) Field of Search ..... 123/73 PP, 55.6, 123/65 VB, 73 S, 430

(56) References Cited

U.S. PATENT DOCUMENTS

| | | | | |
|---|---|---|---|---|
| 4,253,433 | A | 3/1981 | Blair | |
| 6,564,760 | B2 * | 5/2003 | Laydera-Collins | 123/73 AA |

FOREIGN PATENT DOCUMENTS

| | | | |
|---|---|---|---|
| DE | 26 50 834 | A1 | 6/1977 |
| EP | 0 922 660 | A1 | 4/2000 |
| WO | 00/43650 | A1 | 7/2000 |
| WO | 01/51784 | A1 | 7/2001 |

* cited by examiner

*Primary Examiner*—Henry C. Yuen
*Assistant Examiner*—Katrina Harris
(74) *Attorney, Agent, or Firm*—Pearne & Gordon LLP

(57) ABSTRACT

A crankcase scavenged internal combustion engine includes a cylinder and a piston reciprocating along the cylinder wall. At least one auxiliary duct is arranged with an auxiliary port in the cylinder wall. An inlet is divided into: a fuel inlet leading to a fuel port and an air inlet leading to an air port. The auxiliary port, fuel port and air port can be opened and closed by the piston. The piston also comprises a transfer space, which mouth edges are limited by the piston periphery, and which, in at least one piston position, creates a connection between the fuel port and the auxiliary duct's port, so that fuel can be supplied to the auxiliary duct via the auxiliary port, and then, after the port later on has been opened by the piston, can flow into the combustion chamber.

23 Claims, 10 Drawing Sheets

CRANKCASE SCAVENGED INTERNAL COMBUSTION ENGINE

This application claims the benefit of International Application Number PCT/SE01/01028, which was published in English on Nov. 21, 2002.

TECHNICAL FIELD

The subject invention refers to a crankcase scavenged internal combustion engine of two-stroke type, primarily intended for a handheld working tool, such as a chain saw, a trimmer or a power cutter, with a cylinder and a piston reciprocating along the cylinder wall, which piston separates a combustion chamber above it and a crankcase volume below it, and in the cylinder wall there are ports arranged for air inlet, exhaust outlet and for a number of scavenging ducts, which connect the combustion chamber with the crankcase.

BACKGROUND OF THE INVENTION

A two-stroke engine can be built simple and light and with a high power in relation to its low weight. This has resulted in that it is frequently used for portable working tools, particularly since a crankcase scavenged engine can be equipped with a simple and all-position lubrication system. A well-known problem is however that air/fuel mixture will be lost through the exhaust port during the scavenging process of the engine. This results in increased fuel consumption as well as increased exhaust emissions. A way to reduce this problem is described in U.S. Pat. No. 4,253,433. The engine is equipped with at least one additional scavenging duct. This debouches beyond the other scavenging duct as seen from the exhaust port. The other scavenging ducts are scavenging clean air from the crankcase and this air is intended for use as a buffer in order to prevent the scavenging gases released from the additional scavenging duct, which contain air/fuel mixture, from reaching the exhaust port. This can accordingly be described as a stratified scavenging that is stratified in space. The engine has two completely separate air inlets and the one connects to the crankcase for feeding this with fresh air. The other air inlet is provided with a carburetor and debouches into the additional scavenging duct, so that air/fuel-mixture will be sucked down into this scavenging duct when the piston is moving upwards in its intake stroke. When the piston later on is moving downwards in its working stroke the air/fuel-mixture will be scavenged through the port of the additional scavenging duct. Each air inlet is provided with a valve called C and D respectively, which is located where the inlet connects to the additional scavenging duct and to the crankcase respectively. These valves are usually of check valve type, so called Reed-valves. However, the valves C and D could also be valves driven and controlled by the piston's movement or by the crankshaft's rotation. This will however be much more complicated than using the automatic check valves. Both air inlets must be provided with at least one throttle valve each and the movement of these throttle valves must be synchronized, e.g. by using one or more external link rods. Obviously this would be complicated, costly and rather sensitive. Furthermore, the additional scavenging duct is arranged as an integrated part of the cylinder and the crankcase. This means that die-casting of the cylinder would be either impossible or considerably more complicated to carry out, thus resulting in an expensive cylinder.

DE 2650834 shows an engine equipped with additional scavenging ducts intended for a rich air/fuel mixture. These scavenging ducts are located beyond the scavenging ducts for scavenging of fresh air, so that also here a stratified scavenging in space can be achieved. All scavenging ducts are closed, so that die-casting would be impossible or considerably more complicated to carry out. Also this engine has two completely separate air inlets, each of them equipped with at least one throttle valve, which thus must be synchronized. Consequently, the engine has a duct intended for a rich mixture released from an auxiliary carburetor and this duct connects to the additional scavenging ducts by way of check valves or by control of the piston in one embodiment. This means a simplification compared to U.S. Pat. No. 4,253,433, at least for those variants where the valves C and D are driven and controlled by the piston motion or by the crank motion.

Common to both these solutions is that the scavenging will create a stratification in space so that fresh air will be scavenged closest to the exhaust port and hopefully prevent the air/fuel-mixture from reaching the exhaust port. Experience shows however that this cannot be fully prevented meaning that the air/fuel-mixture will manage to reach the exhaust port and thereby be lost through this. Obviously, this will occur to a much smaller extent than in a conventional engine, but of course this is still undesirable.

PURPOSE OF THE INVENTION

One purpose of the subject invention is to provide a cost effective crankcase scavenged internal combustion engine achieving essentially decreased fuel losses compared to a conventional two-stroke engine. Another purpose is to provide an engine achieving even further decreased fuel losses compared to engines of prior art.

SUMMARY OF THE INVENTION

The above-mentioned purposes are achieved in an internal combustion engine in accordance with the invention having the characteristics appearing from the appended claims.

The crankcase scavenged internal combustion engine according to the invention is thus essentially characterized in that at least one auxiliary duct is provided with an auxiliary port in the cylinder wall, which auxiliary port is opened and closed by the piston, and in that the inlet is divided into: a fuel inlet leading to a fuel port, and an air inlet leading to an air port, and in that these ports are opened and closed by the piston, which also comprises a transfer space, which mouth edges are delimited by the piston periphery and which, in at least one piston position, creates a connection between the fuel port and the auxiliary port, so that fuel can be supplied to the auxiliary duct via the auxiliary port, and then, after the port later on has been opened by the piston, can flow into the combustion chamber. Owing to the fact that the engine has one inlet that divides into two parts the engine's regulating valves can be mounted into this single inlet, so that the need for valves in separate inlets can be eliminated, as well as the need of synchronizing the movement of these valves. This will lead to a substantial simplification. Preferably high-speed fuel will be added to the one part, i.e. the fuel inlet.

In elaborated designs of the invention the scavenging process in the additional auxiliary duct can be delayed in relation to the scavenging of air. Thereby the risk that the air/fuel-mixture will reach to the exhaust port will decrease further. This can be described as a scavenging that is stratified both in space and in time. The delay will take place, e.g. in that exhaust gases, or exhaust gases together with air, are located above the air/fuel-mixture in the auxiliary duct and will be scavenged into the cylinder before the mixture.

These and other characteristic features and advantages will become more apparent from the detailed description of various embodiments with the support of the appended drawing figures.

BRIEF DESCRIPTION OF THE DRAWINGS

The invention will be described in closer detail in the following by way of various embodiments thereof with reference to the accompanying drawing figures.

DESCRIPTION OF EMBODIMENTS

Figure 1:
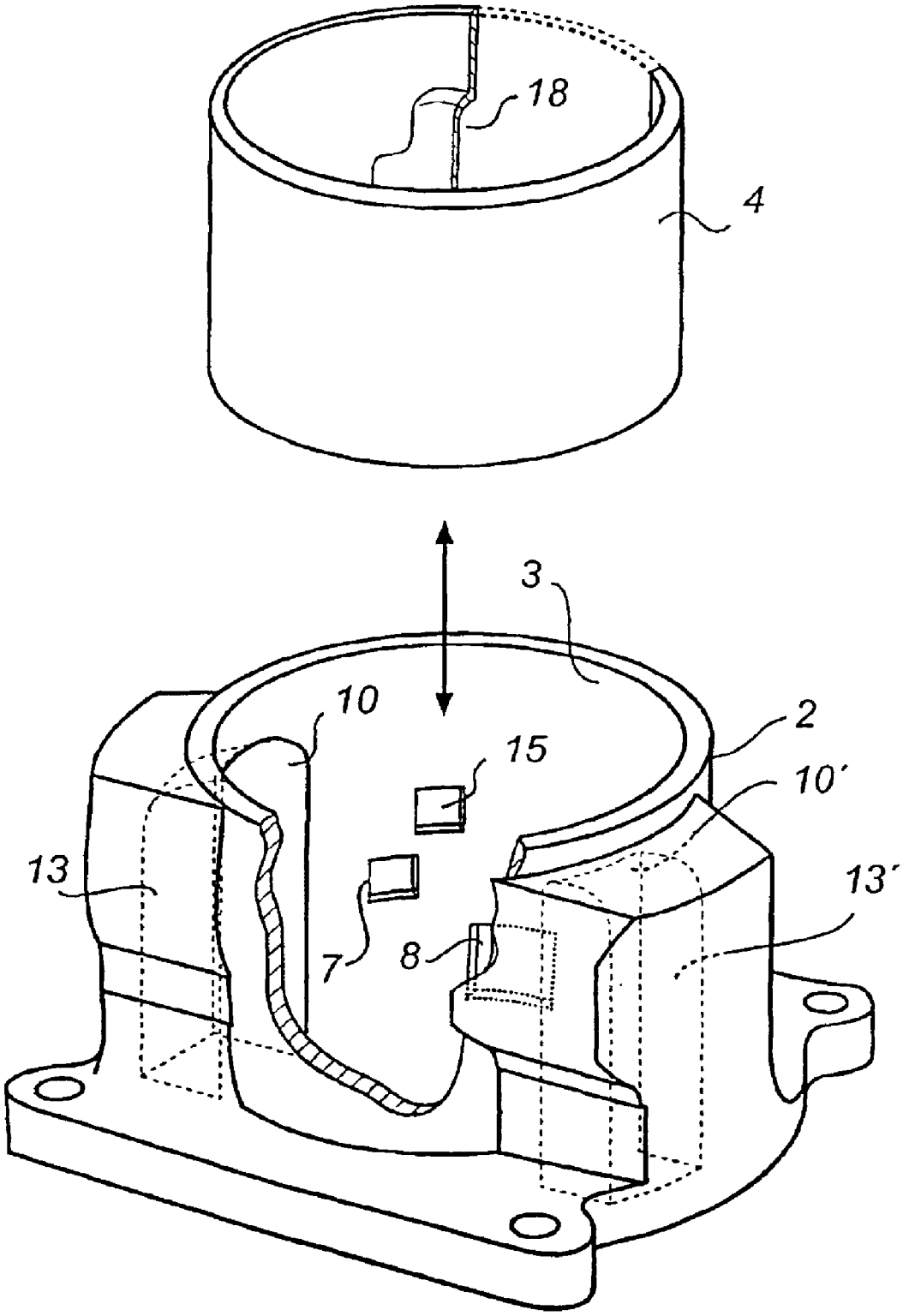
FIG. 1 is a partly cut perspective view of a cylinder and a piston in an engine according to a first embodiment of the invention.
Figure 2:
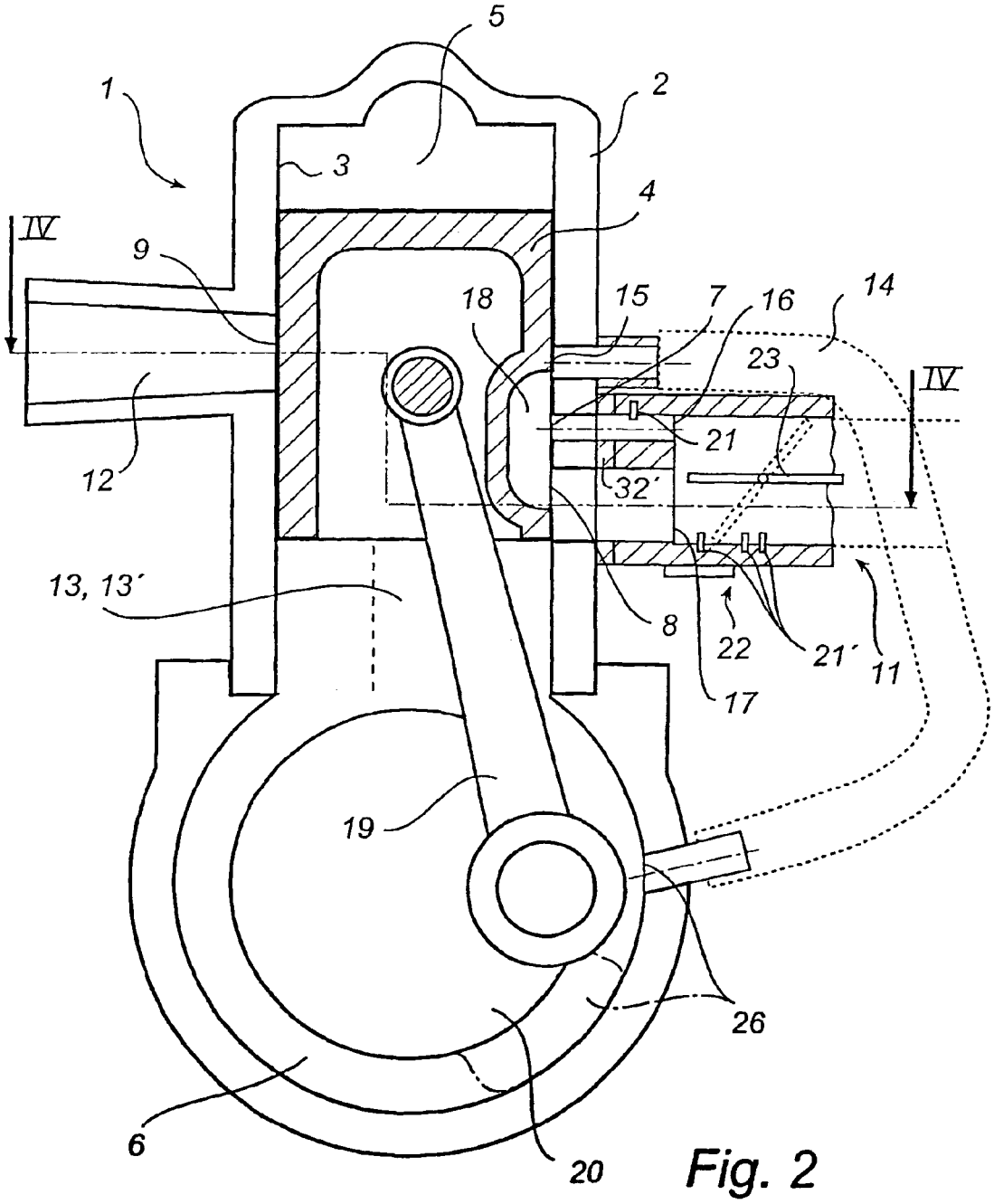
FIG. 2 shows straight from the side an engine according to the first embodiment. The cylinder is shown in cross-section, as well as parts of the piston and the inlet.

With reference to FIGS. 1 and 2 reference numeral 1 designates a crankcase scavenged internal combustion engine according to a first embodiment of the invention. It is of two-stroke type and has scavenging ducts 13, 13'. The engine has a cylinder 2 and a crankcase 6, a piston 4 with piston rod 19 and crank mechanism 20. Furthermore, the engine has an inlet 11, which divides into: one fuel inlet 16 leading to a fuel port 7, and one air inlet 17 leading to an air port 8. The denominations fuel inlet and air inlet refers to the general use at high-speed operation.

Figure 3:
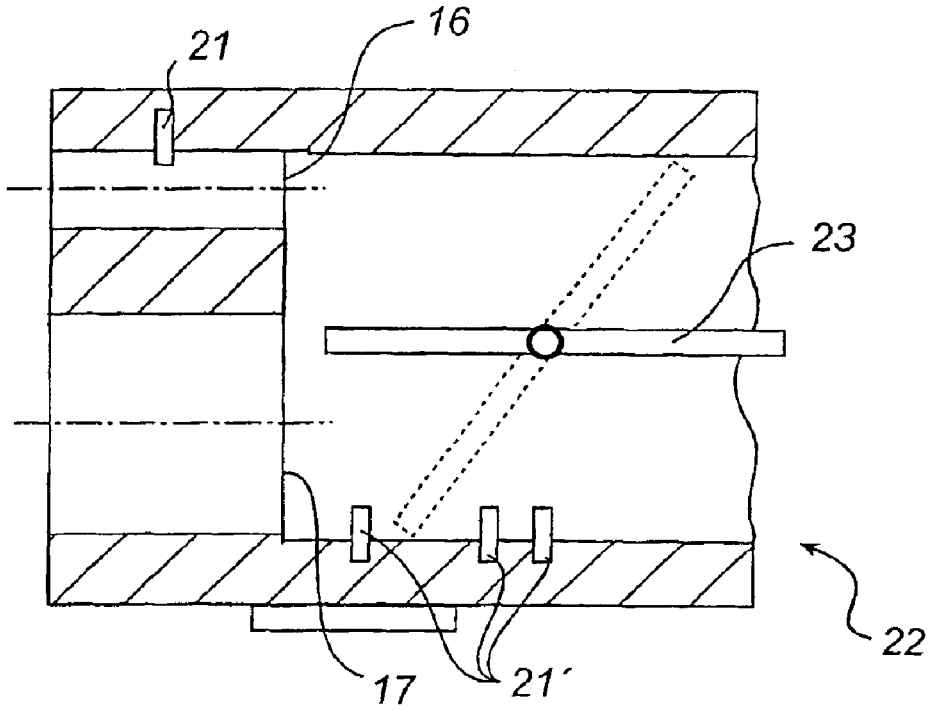
FIG. 3 is an enlarged partial view of the inlet with a carburetor according to FIG. 2.

The design of the carburetor 22 is shown in closer detail in FIG. 3. At its fuel inlet 17 it has a high-speed nozzle 21. Fuel is thus added by way of a carburetor 22, but could as well be added by way of a fuel injection system, e.g. of low pressure type. A number of low-speed and idle nozzles 21' are arranged in the inlet 11 before it branches. These nozzles are located in connection to the air inlet 17, so that the fuel can be transported by the air stream into the air inlet. A high-speed nozzle 21 in the fuel inlet 16 will take care of the supply of fuel at normal throttle or at full throttle, so that the air stream in the fuel inlet 16 will bring the fuel into the fuel port 7. The main part of the fuel that is supplied to the engine will at least at high-speed operation be supplied into the fuel inlet 16, and by way of the high-speed nozzle 21. Preferably, said high-speed nozzle 21 will be closed mechanically in connection with partial throttle and/or idling. Fuel is then supplied to the inlet through the lower nozzles 21'.

The carburetor 22 usually connects to an intake muffler having a filter. These are not shown for the sake of clarity. The same applies for the engine's muffler. Furthermore, the engine has a combustion chamber 5 with a spark plug, which is not shown. All this is entirely conventional and will therefore not be described in closer detail.

What is characteristic is that the inlet 11, here in the form of the carburetor 22, is provided with a regulating throttle valve 23 arranged upstreams the dividing into fuel inlet and air inlet. Hereby separate synchronized valves for the fuel inlet and the air inlet can be avoided, which is an essential simplification. The regulating throttle valve 23 will regulate the inflow of air into the engine. At idle the valve 23 will be rotated into a first position so that the inlet essentially will be covered by it, while at full throttle it will be arranged in a second position essentially in parallel with the direction of the airflow. Between these two positions the regulating valve can take up various positions depending on the desired amount of air supply.

By air port 8 is here and in the following meant the connection's port on the inside of the cylinder while its port on the outside of the cylinder is denominated outer connecting port 32'. Said outer connecting port 32' is preferably arranged as a connection piece 32'. The inlet 11 preferably connects to an inlet silencer provided with a filter so that cleaned fresh air can be taken in. However, if the quality demand on the air should be lower this is of course not necessary. For the sake of clarity the inlet silencer is not shown here.

Furthermore, the design of the piston 4 is characteristic, which becomes evident from FIG. 2, in that it has a peripheral recess 18. Together with the cylinder wall 3 the piston recess creates a transfer space 18 for air/fuel-mixture. Said transfer space 18 is preferably arranged in order to function as a connection between the fuel port 7 and an auxiliary port 15 during at least some piston positions. This connection thereby creates an open connection between the auxiliary port and the fuel port 7, said open connection is closed against the remaining system. In this way the system is supplied with air/fuel-mixture.

A very important characteristic feature is an auxiliary duct 14, which function will be described in closer detail in the following and with reference to the drawing figures. As becomes apparent from FIG. 2 the auxiliary duct 14 is arranged outside the cylinder in a preferred embodiment of the invention. The. auxiliary duct 14 is adapted to hold the air/fuel-mixture sucked in from at least one piston stroke. The auxiliary port 15 is within the combustion chamber 5 arranged beyond the scavenging ports 10, 10', as seen from the view of the exhaust outlet port 9. The auxiliary duct 14 creates in the first embodiment a connection between the cylinder 2 and the crankcase 6. At its connection to the crankcase 6 a crankcase valve 26 could be arranged.

Owing to the external location of the auxiliary duct 14 relatively the combustion engine body 1 it is easily accessible for adjustments when testing the engine. The auxiliary duct 14 is easy to replace and the dimensions can be varied according to need and desire for achieving optimal performance of the system. The auxiliary duct 14 could preferably be composed of a hose which is fixed around therefore adapted connections 32 on the engine body 1. In this case the hose could easily be shortened if required for achieving a suitable volume in the auxiliary duct 14. The most important advantage is that the cylinder can be designed so that it can be manufactured to a low cost by using the die-casting process.

Figure 4:
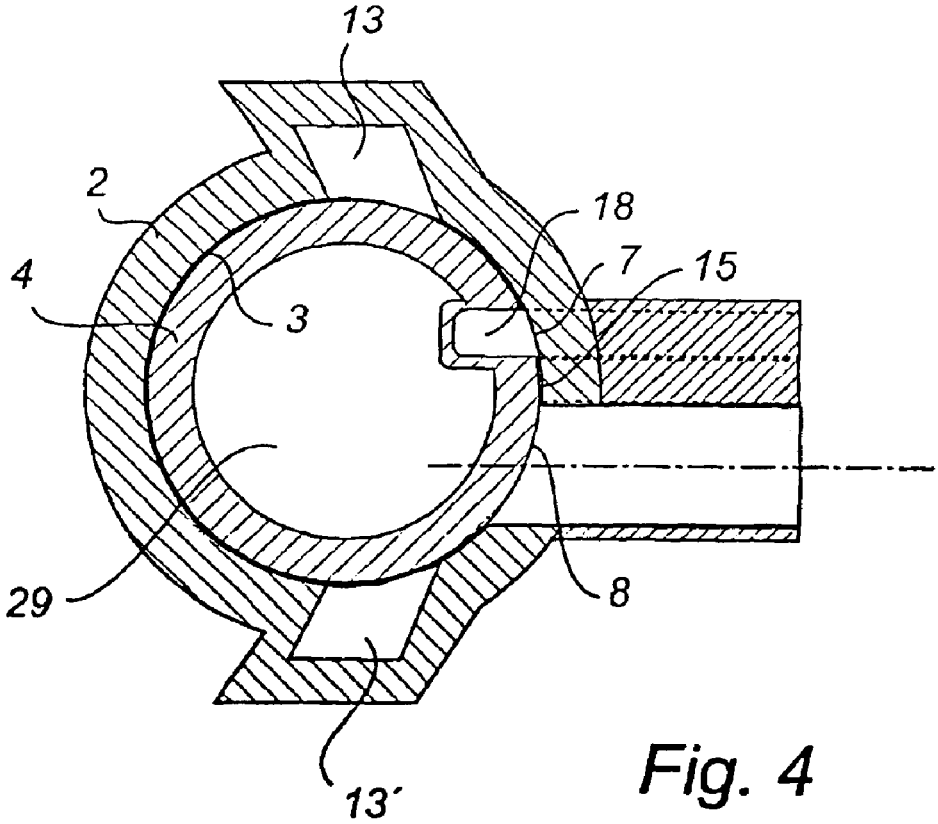
FIG. 4 is a cross-section according to section IV—IV in FIG. 2.

The design of the engine 1 is clearly shown in FIG. 4. The cylinder 2 is preferably produced by die-casting. It has at least one and preferably two symmetrically arranged scavenging ducts 13, 13' in the form of axial ditches along the cylinder bore 29, i.e. so called open scavenging ducts. Together with the piston 4 these axial ditches are creating the scavenging ducts 13, 13', which run along the cylinder's 2 extension in the cylinder wall 3. The ditches have a longer extension than the piston has and thereby the scavenging ports 10, 10' are created on both sides of the piston 4 when this is located at or close to its bottom dead center position. By the piston's 4 movement in the cylinder bore 29 up from the bottom dead center the scavenging ports 10, 10' are closed.

Furthermore, FIG. 4 shows a section of the piston with the transfer space 18. The piston recess is located laterally essentially opposite the fuel port 7 to be able to allow the connection to the auxiliary duct 14 via the auxiliary port 15. As becomes evident from the figure the fuel inlet 16 and the air inlet 17 are parallell at least in the cylinder wall 3. The connections to the fuel inlet 16, the air inlet 17 and the auxiliary duct to the cylinder 2 are composed of connections 32', 32. As described above the connection 32 for the auxiliary duct 14 is running parallel with the connection 32' for the inlet 11.

Figure 5:
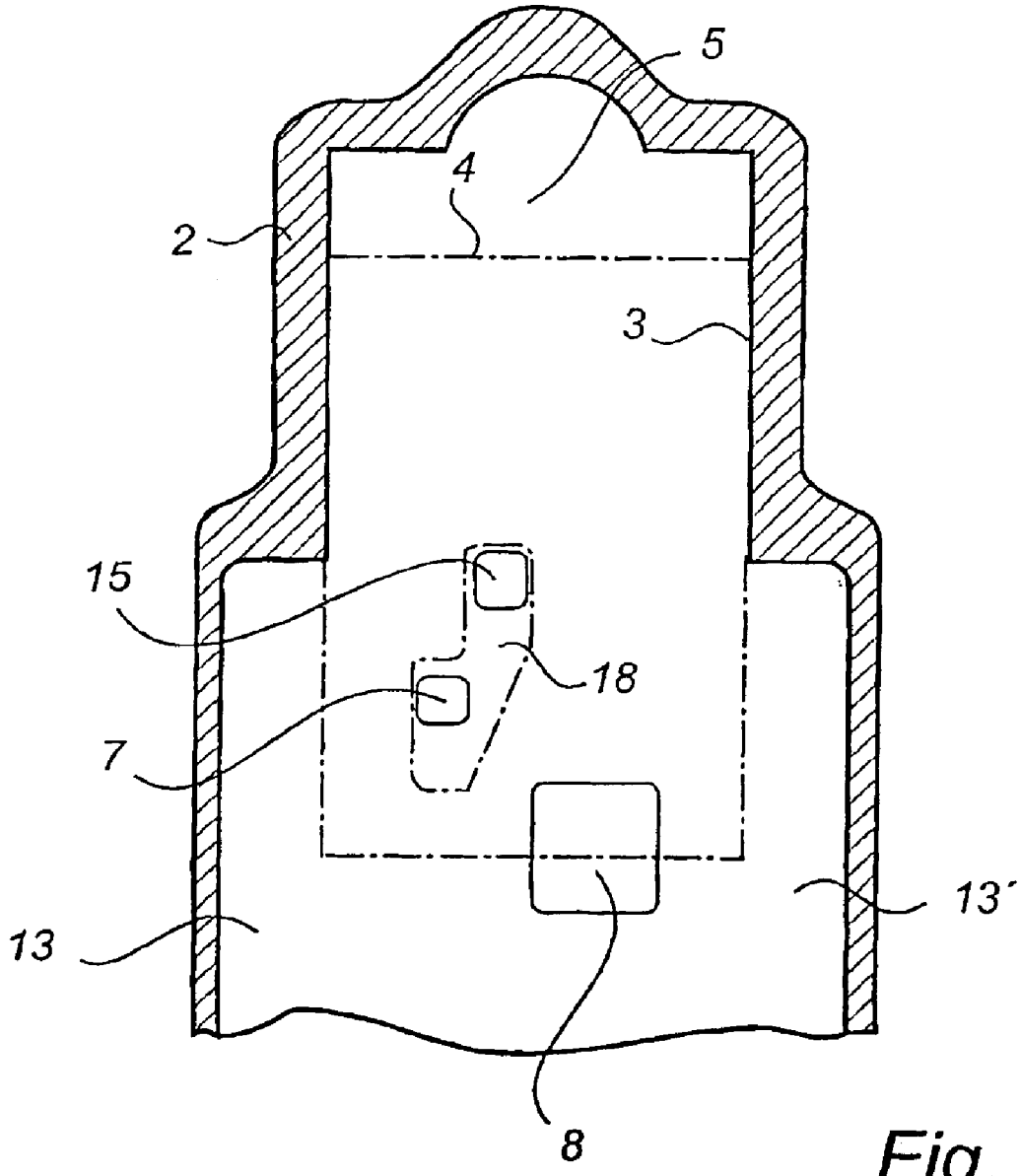
FIG. 5 shows a cross-section straight from the side of the cylinder according to FIG. 2.

With reference to FIG. 5 the ports' location in relation to each other in the cylinder 2 will be further described in the following. As becomes apparent from the figure the ports 7, 8 of the inlet and the port 15 of the auxiliary duct 14 in the cylinder 2 are located side-shifted in relation to each other. The recess 18 must be laterally displaced in relation to the air port 8, so that it is unable to connect the air port 8 with the auxiliary port 15. Consequently, thereby the fuel port 7 and the auxiliary port 15 must be located side-shifted in relation to the air port 8. Otherwise the cylinder bore and stroke would have to be increased. On the other hand the recess 18 should be able to connect the auxiliary port 15 with the fuel port 7. In the shown embodiment the ports 7 and 15 would not have to be side-shifted. However, this is required for the second or the third embodiment according to the FIGS. 11–13, which show a piston opening 31, which shall be able to connect with the auxiliary port 15 but not with the fuel port 7. The scavenging port 10, 10', which is not shown here but is composed of the upper part of scavenging duct 13, 13', has an upper limiting edge in the cylinder wall 3 that is located axially lower down, i.e. closer to the crankcase 6 than the corresponding limiting edge of the auxiliary port's 15 mouth is located in the cylinder wall. Since the scavenging port 10, 10' is placed in the conventional way so that exhaust gases cannot penetrate into the crankcase, the upper limiting edge of the auxiliary duct's port is thus located axially higher up than the corresponding limiting edge of each scavenging duct. This simplifies penetrating of exhaust gases 37 into the auxiliary duct and thereby the air/fuel-mixture 36 begins to be scavenged later. In the figure is also indicated bow the recess 18 in the piston 4 is designed for creating the transfer space 18 between the fuel port 7 and the auxiliary port 15 according the subject invention.

Figure 6:
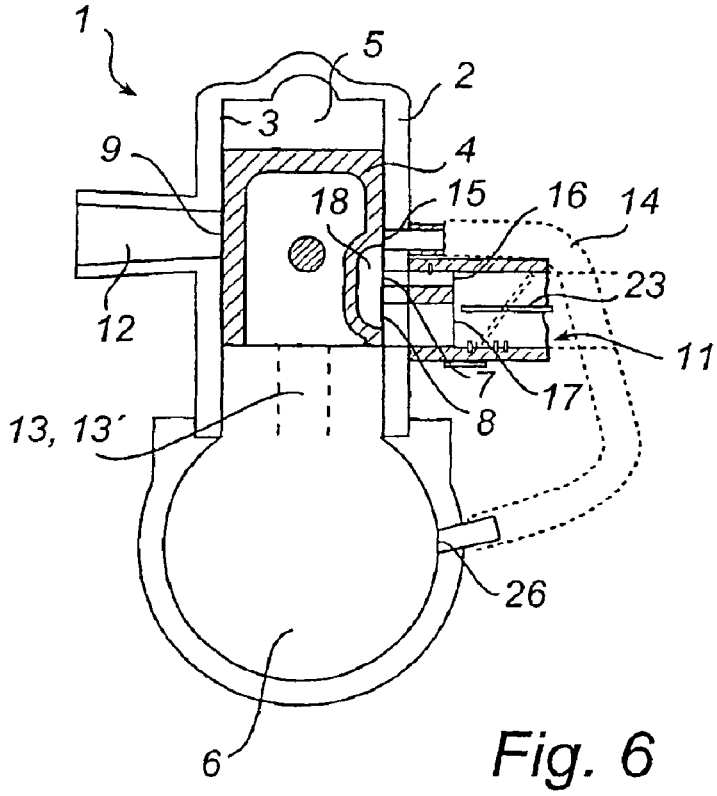
FIGS. 6–10 show a simplified cross-sectional view of the engine as seen straight from the side in various stages of a piston movement sequence.

The function of the internal combustion engine according to the invention will now be described in closer detail with reference to the drawing FIGS. 6–10 which show different steps of the engine's working order. FIG. 6 shows schematically the first embodiment of the engine 1. The piston 4 is in this position on its way up in the cylinder bore. It has already passed the exhaust outlet port 9 so that this is now closed, whereby the pressure in the air/fuel-mixture in the combustion chamber 5 is being built up concurrently with that the piston is moving upwards.

Figure 7:
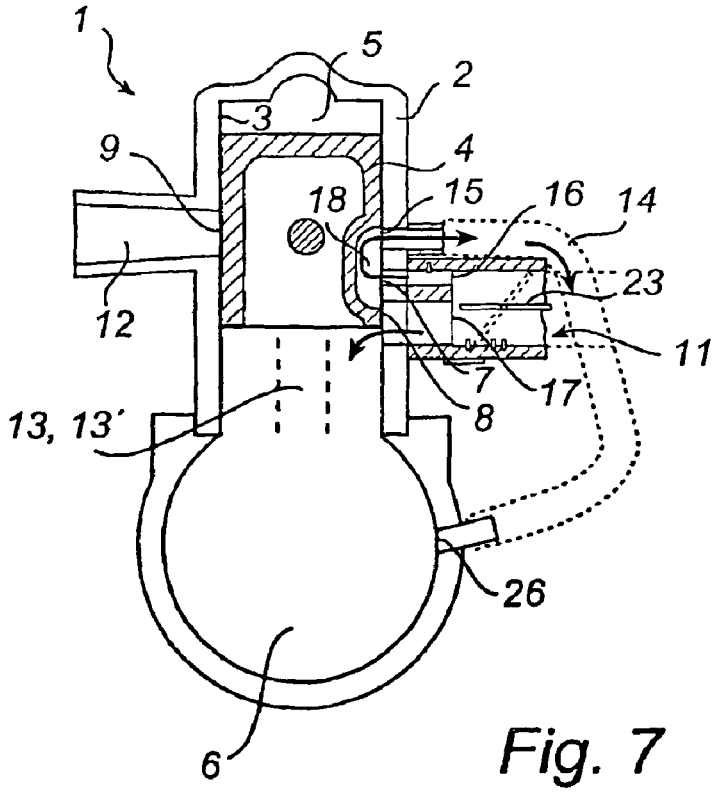

In FIG. 7 the piston 4 is shown in a position close to its upper turning-point in the cylinder 2. The arrows are here indicating the inflow direction for an air/fuel-mixture 36 in the auxiliary duct 14 from the air/fuel-inlet 16 via the transfer space 18 as well as the inflow direction of fresh air through the air port 8 into the crankcase 6. The piston 4 then reaches its top turning-point in order to then move back downwards. Approximately at this position a combustion in the known way will start in the combustion chamber 5.

Figure 8:
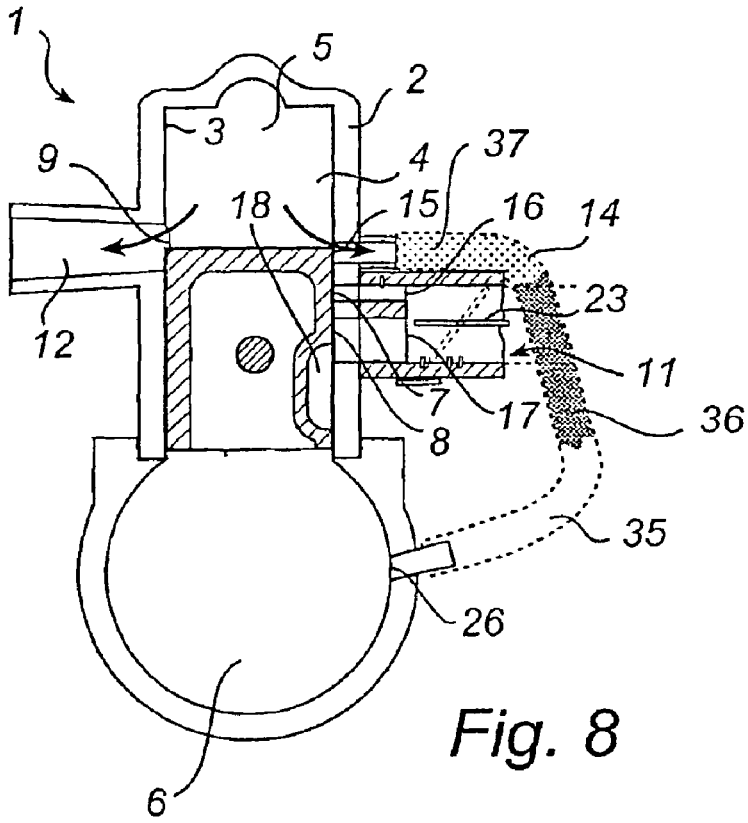
Figure 9:
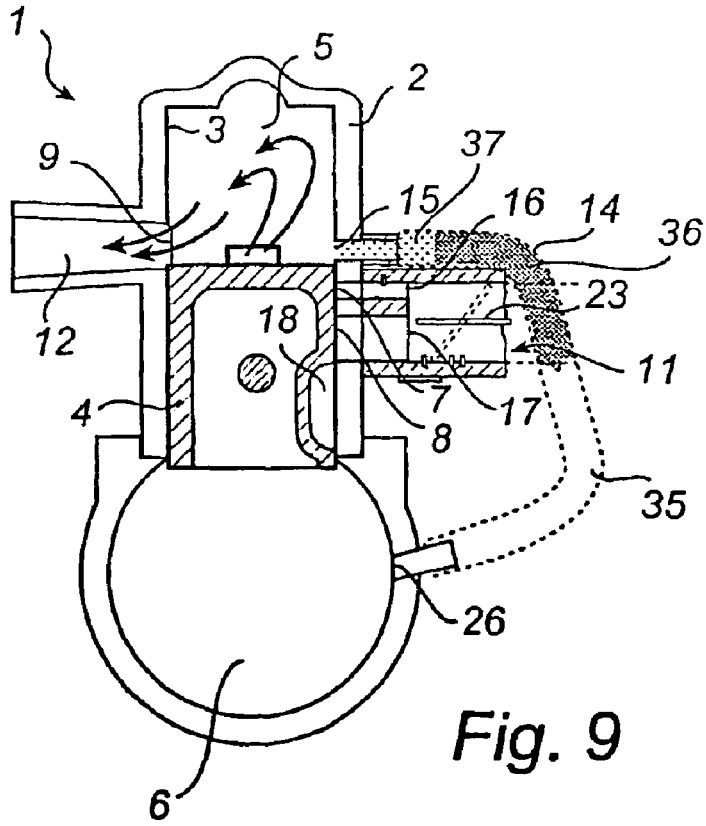

In FIG. 8 the engine 1 is shown schematically in a position where the piston 4 is on its way downwards and has passed the exhaust outlet port's 9 upper limiting edge. Exhaust gases are flowing out from the combustion chamber 5 due to their high pressure compared to the surroundings, and the main part flows out through the exhaust port. Some of the exhaust gases 37 also start to flow into the auxiliary duct 14 via the auxiliary port 15 when this later gradually becomes opened by the piston 4. In the auxiliary duct there is now fresh air 35 in the area closest to the crankcase 6 and exhaust fumes 37 in the area closest to the combustion chamber 5. Between the two exhaust areas in the auxiliary duct 14 there is a volume with air/fuel-mixture 36. The total volume of the auxiliary duct is adapted to hold these exhaust volumes. Preferably the auxiliary duct is comparatively narrow in order to prevent the different gases from mixing together, rather they should keep the stratification. Preferably the auxiliary duct 14 has a length larger than 2 times the length of the respective scavenging duct 13, 13'. Owing to the greater inertia of the gas volumes in the auxiliary duct they will start to scavenge later than the gases in the scavenging ducts 13, 13' but the scavenging will be in progress for a longer time.

As the piston continues downwards the pressure in the crankcase 6 increases. In the combustion chamber 5 the pressure decreases as the exhaust gases 37 are flowing out through the exhaust port 9. This is what takes place in the shown position according to FIG. 9. The piston 4 has an upper limiting edge which in this position also has passed the scavenging port's 10, 10' upper limiting edge and pure air from the crankcase is being scavenged into the combustion chamber. Also the mentioned gas volumes 37, 36, 35 in the auxiliary duct 14 can in this position begin to flow into the combustion chamber 5. Exactly when it takes place depends on a number of various moderation precautions, which on the one hand will affect when the outflow from the auxiliary duct 14 will start, and on the other hand when the air/fuel-mixture 36 will later on start to flow into the combustion chamber 5. Since the auxiliary port 15 is located far from the exhaust port 9 the risk of losses of air/fuel-mixture in this position is relatively small, partly owing to that the distance this gas mixture is going to travel in the combustion chamber is as long as possible and partly owing to that first a gas volume consisting of old exhaust gases 37 is going to flow out from the auxiliary duct 14.

Figure 10:
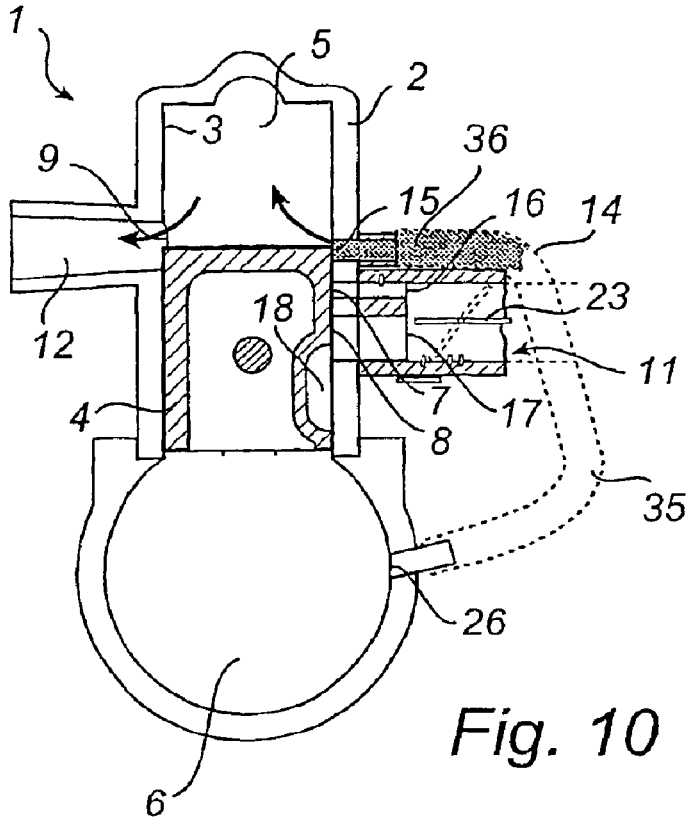

The piston 4 will then change direction at its bottom turning-point and move back upwards in the piston bore. During this time the combustion chamber 5 will be filled with air/fuel-mixture 36 from the auxiliary duct 14 and the last volumes of the exhaust gases 37 are being pressed out through the exhaust outlet 9. In FIG. 10 is schematically shown how fresh air/fuel-mixture 36 is flowing into the combustion chamber 5 and some gases 37 will still flow out. The scavenging ports 10, 10' are in this position closed and the piston 4 continues to move upwards in order to seal the exhaust port 9.

The combustion chamber 5 is now essentially filled with an air/fuel-mixture that is pressurized by the piston 4 during its way up towards the top turning-point. The working order from the beginning that was described schematically in FIG. 6 will now be repeated in this way for each piston stroke.

Figure 11:
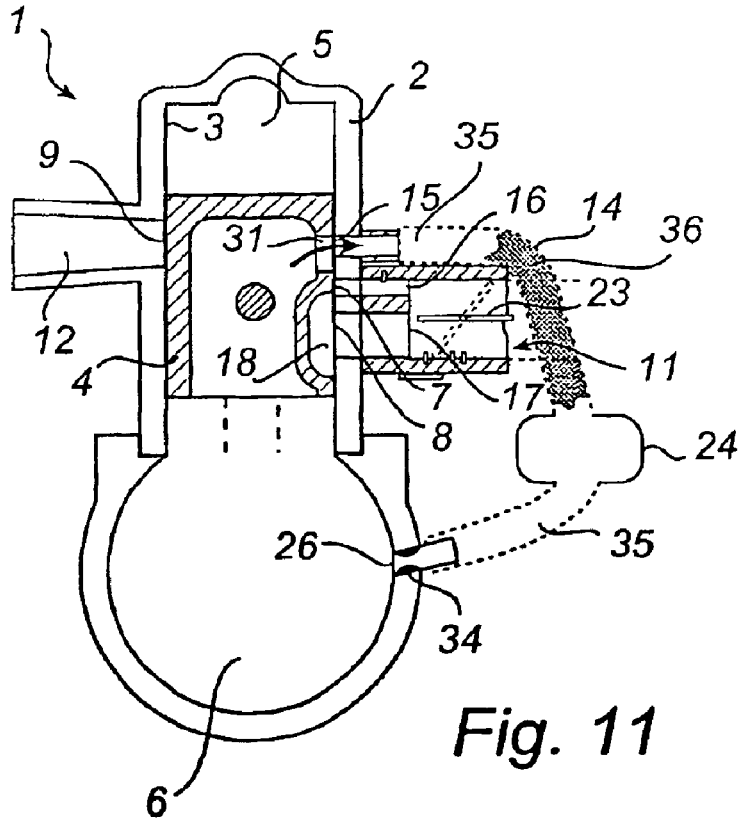
FIG. 11 shows a second embodiment of an engine according to the invention, as seen in cross-section straight from the side.

In order to increase the control of the enclosed gas volume in the auxiliary duct 14 the crankcase inlet of said duct is preferably provided with a crankcase valve 26. FIG. 11 shows schematically a second embodiment of the engine according to the invention, in which the auxiliary duct's 14 inlet instead is designed with a throttling 34. The auxiliary duct 14 is also provided with an extra holder 24. The extra holder 24 can be given an optional design, which preferably is adapted to the available space. Particularly, if it considering the engine design otherwise would be unsuitable to have long auxiliary ducts for holding the adapted fuel mixture this extra volume would be an excellent alternative. The extra holder 24 can be integrated with the auxiliary duct 14 or be mounted to it as a separate extra section. The throttling 34 and the extra holder 24 can also be used in connection with the first embodiment according to FIGS. 1–10. They are used to affect the adaptation of the auxiliary duct 14, so that the air/fuel-mixture is scavenged as late as possible during the scavenging process in order to minimize the amount of fuel that flows from the auxiliary port 15 and out through the exhaust port 9.

Figure 12:
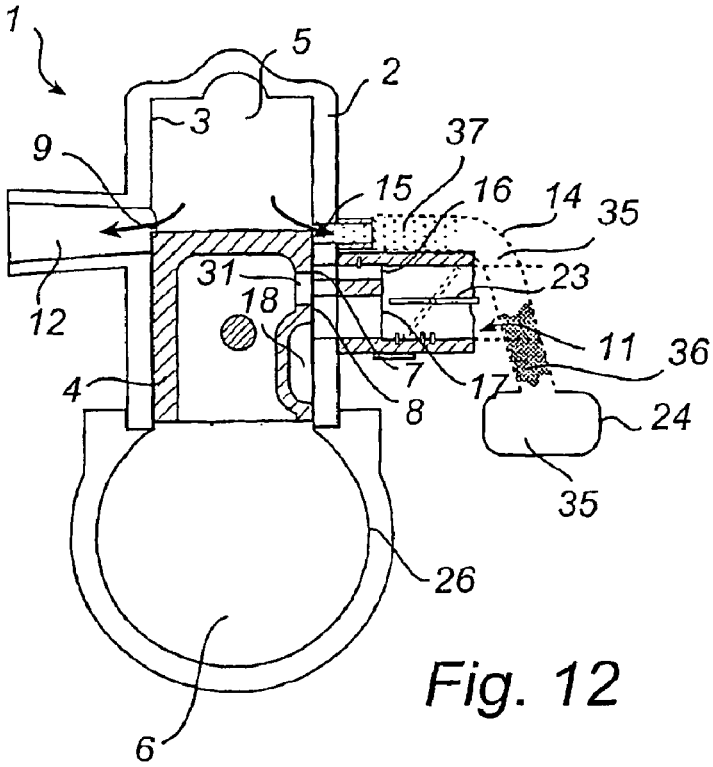
FIG. 12 shows a third embodiment of the engine according to the invention.

What particularly characterizes the second embodiment is that the piston 4 has a penetrating piston aperture 31, which is located axially higher up, i.e. more far away from the crankcase than the transfer space 18 in the piston. FIG. 11 shows a piston position between these shown in the FIGS. 7 and 8. At piston positions close to the top turning-point air/fuel-mixture will be supplied to the auxiliary duct 14 and air will be supplied to the crankcase 6, as shown in FIG. 7. This is particularly true when the piston is moving upwards. When the piston is moving downwards the crankcase compression will increase and the supply stops and the connections between the inlet 11 and the auxiliary duct 14 on the one hand, and the crankcase on the other hand, will disappear. When the piston reaches the point according to FIG. 11 the piston aperture 31 will correspond to the auxiliary port 15 so that air from the crankcase can flow into the auxiliary duct 14 and press the air/fuel-mixture 36 further down into the auxiliary duct. Thereby the scavenging of mixture 36 will start later in the scavenging process, thus reducing the fuel losses out through the exhaust port 9. The flow in the auxiliary duct that took place during the filling according to FIG. 7 has a large inertia owing to the fact that the auxiliary duct is long and narrow. This inertia contributes to suck in air through the piston aperture 31 at the working order according to FIG. 11. This effect can also be reinforced in that the throttling 34 will reduce the inflow of air into the lower end of the auxiliary duct. In FIG. 12 the piston is shown in a position corresponding to that in FIG. 8. Exhaust gases 37 can flow into auxiliary duct 14 and press the air/fuel-mixture 36 further down in the auxiliary duct. Above the mixture 36 there are an air layer 35 and an exhaust layer 37. At the scavenging process the layer 37 will first be scavenged into the combustion chamber followed by layer 35 and only thereafter layer 36 together with the fuel. The stratification would be the same also in the solution according to FIG. 11. At least two advantages can be achieved by the supply of air by means of the piston aperture 31. On the first hand, probably the layers 35 and 37 together would be longer than the layer 37 alone would be according to the first embodiment, see FIG. 1–10. Thereby the result would be that less fuel will be lost through the exhaust port, so that exhaust emissions and fuel consumption will be reduced. On the second hand it is advantageous that there is an air layer 35 closest above the air/fuel-mixture 36. A certain mix between layer 35 and 36 is unavoidable, but could be combustible. For a mix between layer 36 and 37 this would be considerably more uncertain. To summarize it means that if more air can be supplied, either the engine power can be increased, or its exhaust emissions can be reduced at maintained power.

FIG. 12 thus shows a third embodiment of the invention, in which the auxiliary duct 14 is designed to debouche solely into the cylinder wall 3, so that its other end thereby lacks a mouth. Also this embodiment shows an extra holder 24, which enables a sufficient volume in the auxiliary duct 14. To supply the auxiliary duct with fresh air the piston 4 has thus a penetrating piston aperture 31 that connects the crankcase air with the auxiliary duct 14. This is for this embodiment a clear advantage.

Figure 13A:
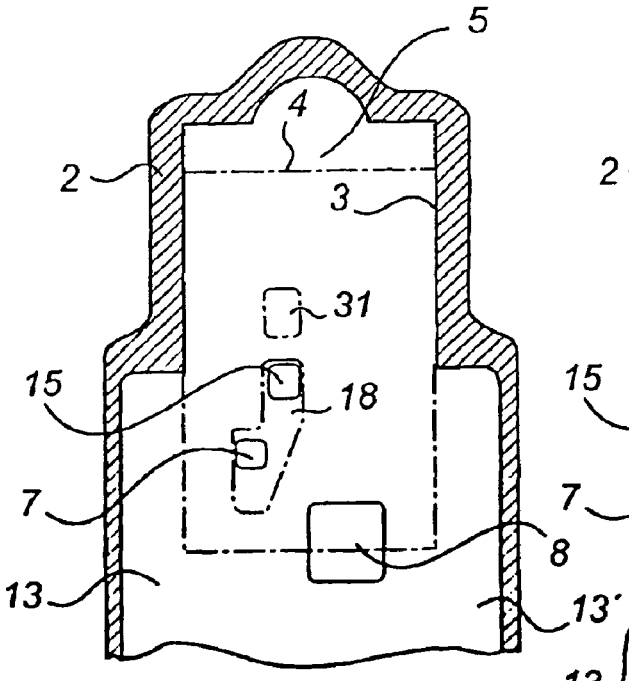
FIGS. 13*a* and 13*b* are showing an enlarged partial view of the cylinder according to the second or the third embodiment of the engine, as seen from the side and where the piston is marked out in various positions by dash-dotted lines.
Figure 13B:
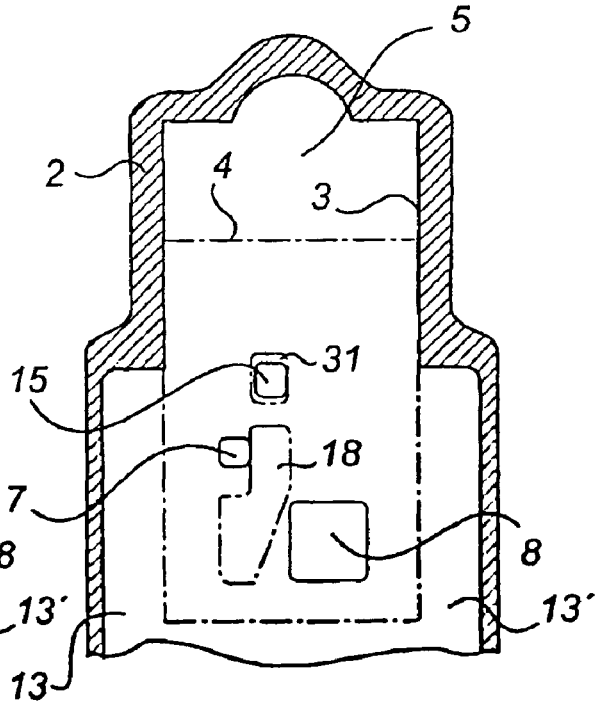

FIGS. 13*a* and 13*b* show a cross-sectional view of the second and the third embodiments of the invention, wherein the piston 4 with the piston aperture 31, is shown in two different positions. In FIG. 13*a* the piston is located in a position where the connection between the auxiliary duct 14, with part 15, and the fuel port 7 is open via the transfer space 18 in the piston 4, compare FIG. 7. In this position air/fuel-mixture will flow into the auxiliary duct 14 via the auxiliary port 15 and air will flow through the air port 8 below the lower edge of the piston down into the crankcase. In the next position, as shown in FIG. 13*b*, the connection between fuel port and auxiliary duct 14 is shut in that the piston 4 has moved downwards, compare FIG. 11. Instead a connection between the crankcase 6 and the auxiliary duct has been established in that the piston aperture 31 takes up a position opposite the auxiliary port 15. Pure air is now flowing into the auxiliary duct 14 as a protection layer above the air/fuel-mixture.

In another embodiment of the invention, which partly is shown schematically in FIG. 2, a crankcase valve 26 is essentially arranged in the crankcase 6 and controlled by the piston's movement so that the auxiliary duct 14 will be throttled for optional piston positions. This is shown by a dash-dotted line as an outgrowth on the crank mechanism 20. When this outgrowth is located opposite the opening of the auxiliary duct 14 in the crankcase this opening will thus be throttled strongly and for optional piston positions depending on how the outgrowth 26 is arranged, i.e. location and angular extension. Consequently, by this simple arrangement a crankcase valve 26 controlled by the crank movement or the piston movement is created. Obviously also an open- and closable valve 26 could be arranged at the auxiliary duct's inlet in the crankcase and be controlled by the crank- or the piston movement. This would however be more complicated. A possibility would be that the outgrowth 26 is so located that it covers the opening of the auxiliary duct in the crankcase in the piston position as shown in FIG. 8, i.e. when the piston just opens the auxiliary port 15. Hereby a pressure pulse from the port 15 will move down into the auxiliary duct and be reflected against the crankcase valve 26, i.e. the outgrowth 26, and then move back up to the port 15. In case the length of the auxiliary duct is suitably adapted the reflecting pressure pulse will give the air/fuel-mixture 36 extra speed into the combustion chamber, particularly preferable if the inlet at the port 15 is directed upwards. By means of the crankcase valve 26 also the scavenging through the auxiliary duct 14 can be slowed down by a suitably adapted throttling during the scavenging process. This could lead to a delayed scavenging resulting in reduced fuel losses through the exhaust port.

Figure 14:
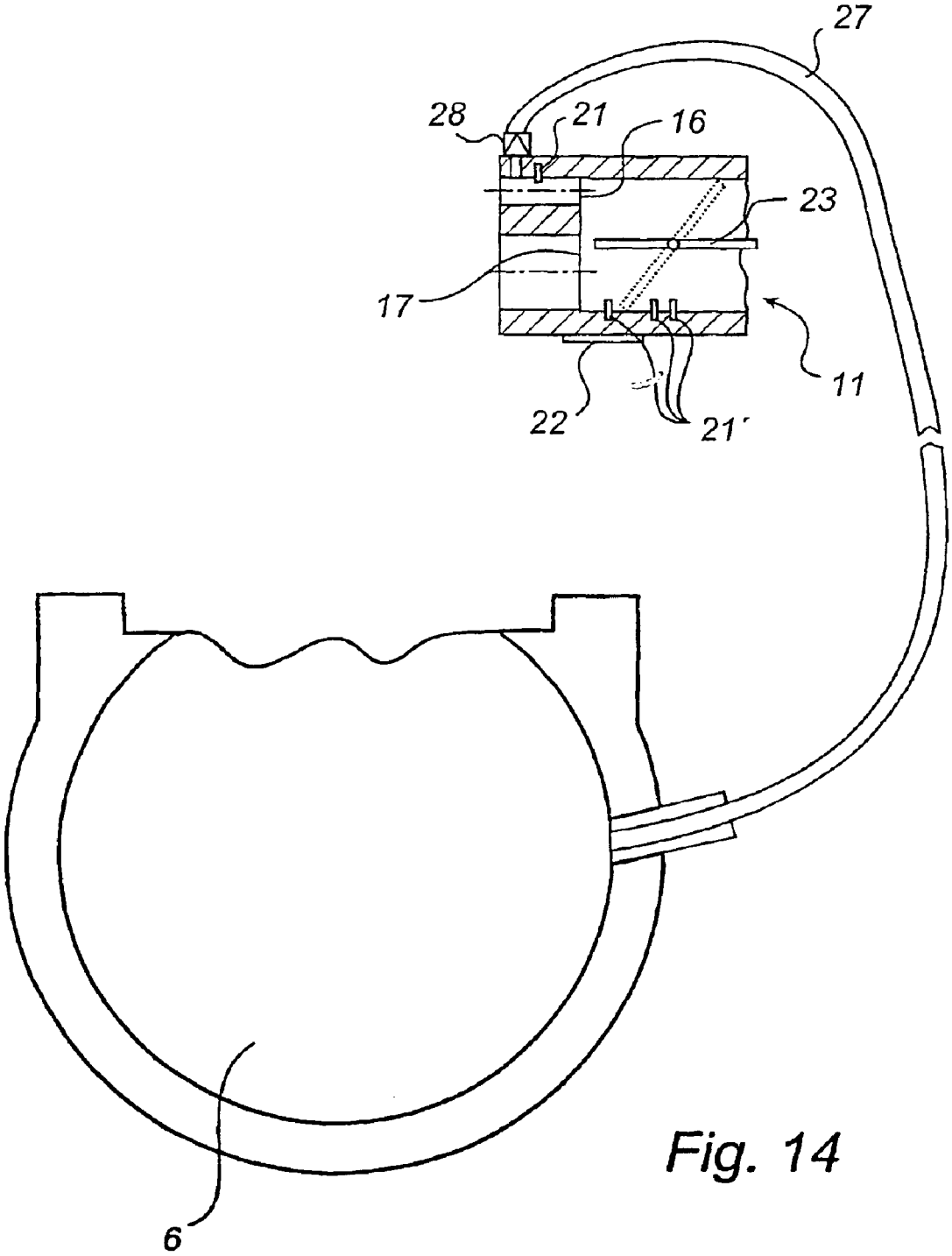
FIG. 14 shows schematically an inlet and a crankcase of the engine according to an embodiment of the invention, equipped with a fuel hose for lubrication of the crankcase.

The crankcase scavenged engine is preferably lubricated in that a lubricant, e.g. oil, is supplied to the crankcase 6. This can be made in many different ways. One way is to pump oil from a tank to the crankcase. In its simplest form this can be arranged in a way very similar to the solution that is shown in FIG. 14. A connecting duct 27 from the crankcase 6 is provided with a check valve 28 and connects to a small oil tank. By means of the pressure pulses in the crankcase oil will be sucked in through the check valve and the connecting duct to the crankcase. The connecting duct 27 can also be provided with a throttle position controlled valve for throttling, so that a control of the oil flow can take place over the engine's throttling range. Another way is that oil is added to the fuel and is supplied via the engine's different nozzles. In this case it would be preferable that some of the low speed nozzles 21' will not be closed entirely during high-speed operation but will supply the crankcase with a small amount of fuel and oil sufficient enough for lubricating the engine. A third way becomes apparent from FIG. 14. A connecting duct 27 from the crankcase 6 with check valve 28 is connected to the fuel inlet 16. Fuel and oil are supplied by the high-speed nozzle 21. Since often a lower pressure prevails in the crankcase compared to the fuel inlet a mixture of air/fuel/oil will be supplied to the crankcase. It would also be possible to put the low-speed jets 21' in the fuel inlet or in connection to it in an upstreams direction, so that essentially all the fuel will be supplied to the fuel inlet.

Figure 15:
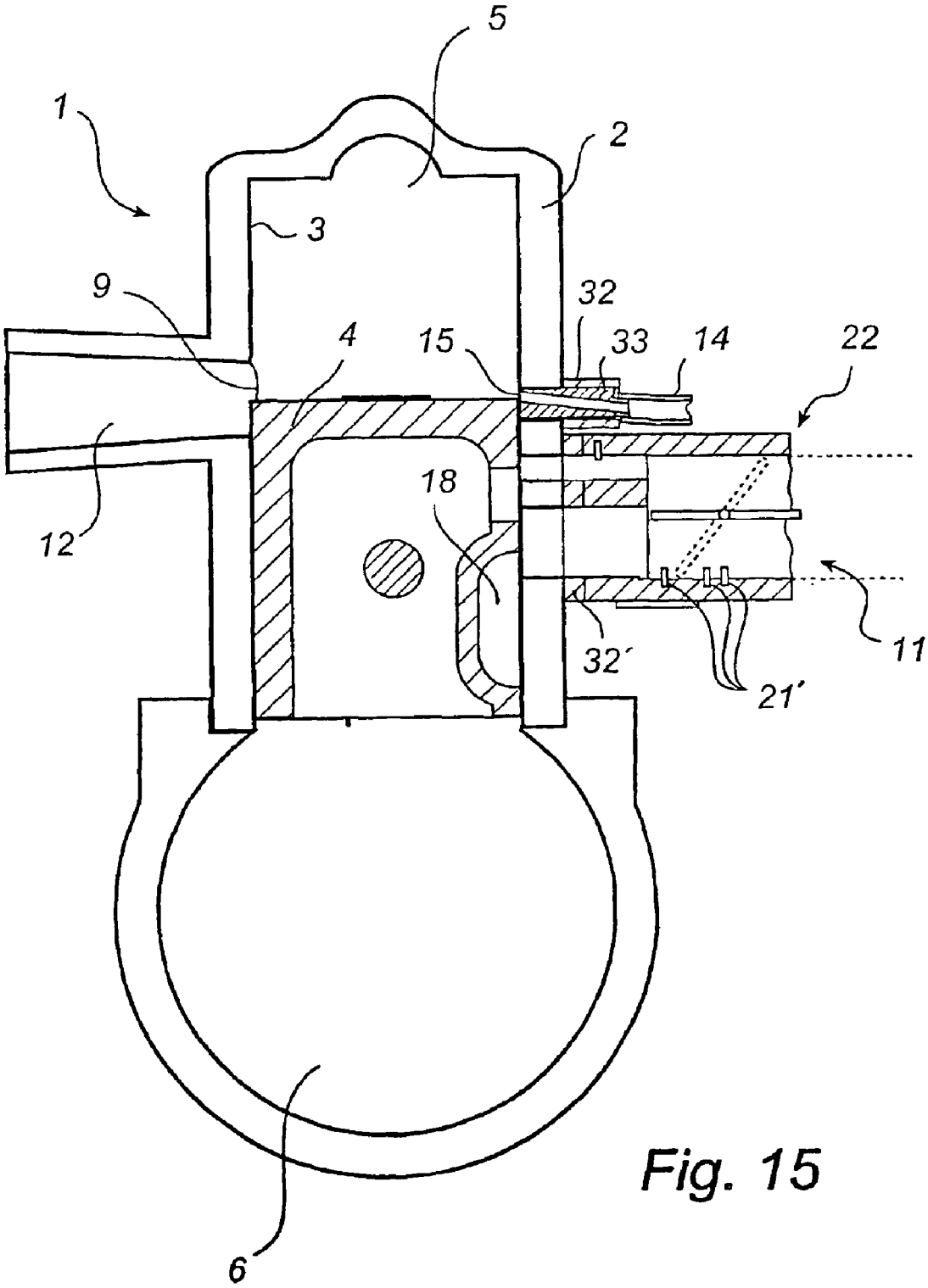
FIG. 15 shows straight from the side a further embodiment of the invention having a connection piece located at the mouth of the auxiliary duct.

FIG. 15 shows an alternative version that can be used together with all the above described embodiments and versions of the internal combustion engine 1 according to the invention, in which the auxiliary duct 14 has a larger connection 32 which is provided with a connection piece 33 with a directed duct for creating a desired flow direction into the combustion chamber 5. The directed duct can also be bent, since it is manufactured as a separate part made of metal, such as aluminum or magnesium or of some kind of plastic, such as polyamide. Since the inflow direction of the gas volume including the air/fuel-mixture 36 from the auxiliary duct in this way is possible to direct away from flowing directly out through the exhaust port 9 a further method to avoid fuel losses from the system will be enabled. In a preferred embodiment is the connection piece 33 inserted in the connection 33 provided with nozzles, around which the auxiliary duct is arranged. This embodiment is particularly advantageous in connection with a die-cast cylinder having three parallel connections 32, 32'. As becomes apparent from FIG. 15 the regulating throttle valve 23 should preferably in full throttle position seal well between the fuel inlet and the air inlet, so that a so called back-spit from the fuel inlet cannot reach the air inlet to any appreciable extent.

A further advantage in that the piston 4, which creates the above-mentioned transfer space 18, serves as a slide valve in the engine is that the need for other valve arrangements for controlling the inflow and outflow to the engine will be eliminated or reduced, which obviously simplifies the manufacturing of the engine substantially, resulting in a cost effective production. However, it is obvious that the engine can be realized in that valves are arranged in the conventional way for controlling the in- and outflow of e.g. gases, even if this is not preferred.

In order to indicate the use of this auxiliary duct for reducing the fuel consumption it is preferable to compare the trapping efficiency with other engines. The trapping efficiency is a measure of how much fuel that can be held in the cylinder after flowing into the combustion chamber. An ordinary four-stroke engine has normally a trapping efficiency of 97%, while a conventional combustion engine of two-stroke type has a trapping efficiency of approximately 80%. The crankcase scavenged internal combustion engine according to the invention has, according to an in the present situation preferred embodiment, a trapping efficiency of approximately 94%.

The invention should of course not be regarded as confined to the shown and described embodiments but can be completed and modified optionally within the scope of protection according to the appended patent claims. Consequently, a number of further alternative embodiments can be created by combining the above-mentioned characteristic features in other ways than the here outlined as non-confining examples.

Thus, the connections to the ports could be given other designs than is described here. The auxiliary duct 14 could obviously be complementary combinable with the cylinder 2 in other ways according to what a person skilled in the art would find appropriate. The volume of the auxiliary duct 14 could also be adjustable and thereby variable in real time in that a controller is allowed to work with said volume. This is primarily preferred in the alternative embodiments of the invention where the auxiliary duct 14 lacks a direct connection with the crankcase 6.

It is also obvious that the sequence in which the different gas layers are arranged in the auxiliary duct can be varied as long as the basic function to create a protective layer for the air/fuel-mixture of a less valuable gas or gas mixture is maintained.

Important application fields where the advantages of the invention is of especially great importance is for example chain saws, however, it can also be used for other portable tools, such as cutting tools, garden tools etc.

What is claimed is:

1. A crankcase scavenged internal combustion engine (1) of two-stroke type, primarily intended for a handheld working tool, such as a chain saw, a trimmer or a power cutter, with a cylinder (2) and a piston (4) reciprocating along the cylinder wall (3), which piston separates a combustion chamber (5) above it and a crankcase volume (6) below it, and in the cylinder wall (3) there are ports (7, 8, 9, 10, 10') for air inlet (11), exhaust outlet (12) and for a number of scavenging ducts (13, 13'), which connect the combustion chamber with the crankcase, characterized in that at least one auxiliary duct (14) is arranged with an auxiliary port (15) in the cylinder wall, which auxiliary port (15) is opened and closed by the piston, and in that the inlet is divided into: a fuel inlet (16) leading to a fuel port (7), and an air inlet (17) leading to an air port (8), and in that these ports are opened and closed by the piston (4), which also comprises a transfers space (18), which mouth edges are limited by the piston periphery and which, in at least one piston position, creates a connection between the fuel port (7) and the auxiliary port (15), so that fuel can be supplied to the auxiliary duct via the auxiliary port (15), and then, after the port (15) later on has been opened by the piston (4), can flow into the combustion chamber.

2. A crankcase scavenged internal combustion engine (1) according to claim 1, in which the main part of the fuel supplied to the engine, at least during high-speed operation, is supplied to the fuel inlet (16).

3. A crankcase scavenged internal combustion engine (1) according to claim 1, in which the auxiliary duct (14) with port (15) is so arranged that it begins to scavenge the air/fuel-mixture (36) at a later stage than the scavenging duct (13, 13') begins to scavenge air.

4. A crankcase scavenged internal combustion engine (1) according to claim 3, in which the upper limiting edge of the auxiliary port (15) is located higher up axially, i.e. more far away from the crankcase (6) than the corresponding upper limiting edge of each scavenging duct's port (10, 10') respectively, so that hereby the penetrating of exhaust gases (37) into the auxiliary duct will be simplified, and thereby the air/fuel-mixture (36) begins to be scavenged later.

5. A crankcase scavenged internal combustion engine (1) according to claim 1, in which the piston (4) has a penetrating piston aperture (31) located higher up axially, i.e. more far away from the crankcase than the transfer space (18) in the piston, so that air can flow into the auxiliary duct (14) and press the air/fuel-mixture (36) further down in the auxiliary duct, so that the mixture (36) begins to be scavenged later.

6. A crankcase scavenged internal combustion engine (1) according to claim 1, in which a crankcase valve (26) is arranged essentially in the crankcase (6), and is controlled by the crank mechanism movement so that the auxiliary duct (14) will be throttled for optional piston positions, whereby a delayed scavenging of the air/fuel-mixture (36) is enabled—among other things.

7. A crankcase scavenged internal combustion engine (1) according to claim 1, in which the auxiliary duct (14) has a length larger than 2 times the length of the respective scavenging duct (13, 13'), so that hereby the scavenging will start later in the auxiliary duct.

8. A crankcase scavenged internal combustion engine (1) according to claim 1, in which the inlet is provided with at least one regulating valve (23) for enabling the amount of air and fuel flowing into the combustion engine (1) to be controlled.

9. A crankcase scavenged internal combustion engine (1) according to claim 1, in which the fuel port (7) and the auxiliary duct's port (15) are located side-shifted in relation to the air port (8).

10. A crankcase scavenged internal combustion engine (1) according to claim 1, in which the auxiliary duct (14) is arranged essentially outside of the cylinder (2).

11. A crankcase scavenged internal combustion engine (1) according to claim 1, in which the auxiliary duct (14) is composed of a demountable, replaceable means, preferably a hose, which is mountable outside of the cylinder and having a suitable length and dimension.

12. A crankcase scavenged internal combustion engine (1) according to claim 1, in which the connection between inlet (11) and auxiliary duct (14) consists of the transfer space (18) in the piston (4).

13. A crankcase scavenged internal combustion engine (1) according to claim 1, having only one auxiliary duct (14).

14. A crankcase scavenged internal combustion engine (1) according to claim 1, in which an extra holder (24) is arranged in connection to the auxiliary duct (14) for taking up a greater gas volume.

15. A crankcase scavenged internal combustion engine (1) according to claim 1, in which the auxiliary duct (14) is arranged as a connection between the cylinder (2) and the crankcase (6).

16. A crankcase scavenged internal combustion engine (1) according to claim 1, having an auxiliary duct (14), which only debouches into the cylinder wall (3), so that its other end thus lacks a mouth.

17. A crankcase scavenged internal combustion engine (1) according to claim 1, in which a lubricant is supplied to the system by way of a fuel duct (27) with a check valve (28) from the fuel inlet (16) to the crankcase (6).

18. A crankcase scavenged internal combustion engine (1) according to claim 1, in which at least one of the connections to the fuel inlet (16), air inlet (17) and auxiliary duct to the cylinder (2) is composed of a connection (32, 32').

19. A crankcase scavenged internal combustion engine (1) according to claim 18, in which the connection (32) for the auxiliary duct (14) is located parallel with the connection (32') for the inlet (11).

20. A crankcase scavenged internal combustion engine (1) according to claim 18, in which at least the auxiliary duct (14) has a larger connection (32), which is provided with a connection piece (33) with a directed duct for creating a desired flow direction into the combustion chamber (5).

21. A crankcase scavenged internal combustion engine (1) according to claim 1, having at least one scavenging duct (13) arranged in the form of axial ditches along the cylinder bore (29), a so called open scavenging duct.

22. A crankcase scavenged internal combustion engine (1) according to claim 1, in which the air/fuel-inlet (16) and the air inlet (17) are running parallel at least in the cylinder wall (3).

23. A crankcase scavenged internal combustion engine (1) according to claim 1, in which the cylinder (2) is die-cast.

* * * * *